US008365507B2

(12) United States Patent
Klingel

(10) Patent No.: US 8,365,507 B2
(45) Date of Patent: Feb. 5, 2013

(54) ASSEMBLY FOR THE PERSON-RELATED FILLING OF MEDICINE DISPENSERS

(75) Inventor: Hans Klingel, Möglingen (DE)

(73) Assignee: Edwin Kohl (DE)

( * ) Notice: Subject to any disclaimer, the term of this patent is extended or adjusted under 35 U.S.C. 154(b) by 532 days.

(21) Appl. No.: 12/304,245

(22) PCT Filed: May 31, 2007

(86) PCT No.: PCT/EP2007/055354

§ 371 (c)(1),
(2), (4) Date: Jan. 21, 2009

(87) PCT Pub. No.: WO2007/141192

PCT Pub. Date: Dec. 13, 2007

(65) Prior Publication Data

US 2009/0250485 A1 Oct. 8, 2009

(30) Foreign Application Priority Data

Jun. 10, 2006 (DE) ..... 10 2006 027 521

(51) Int. Cl.
*B65B 1/30* (2006.01)
*B65B 3/26* (2006.01)
*B65B 57/00* (2006.01)

(52) U.S. Cl. ..... 53/493; 53/492; 53/55; 53/509; 53/237; 53/474; 53/471; 53/472; 83/208; 83/278; 83/250; 83/371; 221/31; 219/121.72; 219/121.82

(58) Field of Classification Search ..... 53/493, 53/492, 55, 509, 237, 474, 471, 472; 83/208, 83/278, 250, 371; 221/31; 219/121.72, 121.82
See application file for complete search history.

(56) References Cited

U.S. PATENT DOCUMENTS

| | | | | |
|---|---|---|---|---|
| 3,903,773 | A * | 9/1975 | Furukawa | 83/208 |
| 5,630,347 | A * | 5/1997 | Elvio | 83/210 |
| 6,318,051 | B1 * | 11/2001 | Preiss | 53/493 |
| 6,642,479 | B2 * | 11/2003 | Klingel | 219/121.72 |
| 7,637,079 | B2 * | 12/2009 | Klingel et al. | 53/55 |
| 7,779,614 | B1 * | 8/2010 | McGonagle et al. | 53/474 |

(Continued)

FOREIGN PATENT DOCUMENTS

| | | |
|---|---|---|
| DE | 2355645 | 5/1974 |
| DE | 29616341 | 1/1998 |
| DE | 102004020510 | 11/2005 |
| FR | 2838047 | 10/2003 |
| WO | WO98/29084 | 7/1998 |

*Primary Examiner* — Gene O. Crawford
*Assistant Examiner* — Rakesh Kumar
(74) *Attorney, Agent, or Firm* — Marger Johnson & McCollom PC

(57) ABSTRACT

In an assembly for filling medicine dispensers (11) with administering units (12/*i*) which are to be taken daily by patients, a deblistering apparatus (39) is provided for the separating, automatic removal of the medicines from the respective blister pack, the blister film (33) of which can be subjected to a notching or cutting pretreatment, only after which the medicine is removed. A transport device (18) is provided which supplies the medicine dispensers (11) to a feeding device, at which the individual medicines can be loaded into receiving compartments (14/1 to 14/4) of the medicine dispenser (11). The assembly comprises modules (17/*i*) which have in each case a blister shaft (62), a punching device and a feeding device and are arranged along the transport device (18) at spacings from one another which correspond to the spacing of the receiving compartments (14/*i*) of the dispensers (11/*i*) or to an integral multiple of said spacing.

18 Claims, 10 Drawing Sheets

U.S. PATENT DOCUMENTS

| | | | | |
|---|---|---|---|---|
| 7,818,950 | B1 * | 10/2010 | McGonagle et al. | 53/474 |
| 7,886,506 | B2 * | 2/2011 | Knoth et al. | 53/475 |
| 7,908,827 | B2 * | 3/2011 | Knoth | 53/473 |
| 2003/0116546 | A1 * | 6/2003 | Klingel | 219/121.72 |
| 2008/0190076 | A1 * | 8/2008 | Klingel et al. | 53/493 |
| 2011/0168733 | A1 * | 7/2011 | Yuyama et al. | 221/1 |
| 2012/0055949 | A1 * | 3/2012 | Stenfelt et al. | 221/1 |

* cited by examiner

ASSEMBLY FOR THE PERSON-RELATED FILLING OF MEDICINE DISPENSERS

TECHNICAL FIELD

Installation for the person-related provisioning of medicament-dispensers with units for administering medicaments.

BACKGROUND

The invention relates to an installation for the person-related provisioning of medicament-dispensers with units for administering medicaments—tablets, coated pills or capsules—which are to be taken by patients in a defined chronological sequence, wherein the medicaments are arranged in an arrangement within the medicament-dispenser which is correlated with the ingestion times, and wherein the medicaments are supplied in standard blister packs which are arranged in "vertical" stacks that contain a plurality of standard blister packs which are arranged one above the other and comprise a defined number of trough-shaped blister cups which each contain an administering unit and are covered with a blister film, said installation having the other generic features mentioned in the pre-characterising clause of patent claim 1.

The installation comprises de-blistering devices which mediate an automatically-occurring, separating removal, from the blister packs, of the medicaments which can then be fed, by means of a delivery apparatus, into receiving compartments in the particular medicament-dispenser which are assigned to the individual administering units. A transporting apparatus is provided, by means of which the medicament-dispensers are supplied to the particular delivery apparatus, for the automatic provisioning of which there are provided electrically controllable drives for the de-blistering devices, the delivery apparatus and the dispenser transport, control of which is mediated by an electronic control unit which generates, from a system for processing machine-readable, person-related data that can be read and processed in a fixedly defined correlation with the transport of the medicament-dispensers, control signals which are required for the provisioning sequence.

For the purpose of preparing and facilitating the de-blistering operation—the removal of selected medicaments from the particular blister cup of the standard blister pack—those regions of the blister film which cover the cup of the selected medicament in each case are subjected to a scratching and cutting treatment by means of a punching tool which is held in readiness in a configuration which is adapted to medicaments. An installation of this type forms the subject of a patent application published in Germany, DE 10 2005 047 429 A1, by this Applicant, the teachings of which are incorporated by reference herein.

In the case of the subject of the earlier patent application, there are provided, inside sub-units of the installation as a whole, which has a modular construction to that extent, rotatable blister-pack stores within which there are associated, with the individual medicaments, relatively narrow sector regions within which a stack of a specific kind of blister pack is arranged in each case. The kind of standard blister pack which is required for provisioning the medicament-dispenser which is currently to be filled in each case is brought, by rotation of the store, into a distributing position in which de-blistering by means of suitable tools, and then the feeding of the de-blistered medicament into the particular medicament-dispenser, takes place.

In a typical configuration of a de-blistering and provisioning unit of this kind, the said unit is arranged between two rotatable medicament stores which are used in an alternating manner for making available blister packs for provisioning the dispensers, the said units—two stores in the form of cylindrical columns and the de-blistering and provisioning unit—forming, so to speak, one module of the installation which, viewed individually, fulfils the basic functions of the installation. The result of this, however, is that an expansion of the known installation to an increased variety of medicaments gives rise to comparatively high expenditure, since an expansion of capacity by one module, which comprises two symmetrically arranged rotary magazines for at least twelve different kinds of medicament in each case, implies illogically high expenditure for practical purposes in a large number of cases.

The installation according to the earlier patent application is designed for the provisioning of medicament-dispensers which have a, so to speak, single-row arrangement of receiving compartments, that is to say a configuration which, although it is highly suitable for making available a patient's daily requirement, is nevertheless not suitable for the systematic reception of an entire weekly requirement, such as is expedient, and therefore often also required, in the case of prolonged treatments.

Added to this is the fact that the installation according to the earlier patent application is subject, on account of the cylindrical stores of relatively large construction, to limitations as regards the cycle time since it is necessary, depending upon the localising of the medicament blister pack within the rotary magazine, to travel through relatively large angles of rotation in order to call at the provisioning position, and it is also necessary to move relatively large masses, so that, notwithstanding the possibility of using higher-powered drives, an increased amount of time is required because of the fact that high rotary accelerations are to be avoided since they only lead to undesirable forces acting upon the medicaments and can damage the latter, something which would not be acceptable.

Embodiments of the invention improve an installation of the type initially mentioned, to the effect that an increased provisioning output —an increased number of provisioned medicament-dispensers per unit of time—is achieved with comparatively little expenditure in terms of construction, and the installation can also be brought, in a simple manner, into a configuration that satisfies a desired provisioning capacity.

According to this, the modules that form the installation as a whole comprise, in each case, a magazine shaft in which a fairly large number of standard blister packs are held in readiness in a stack, a punching apparatus and also a delivery apparatus, wherein the modules are arranged, along the transporting apparatus which is normally of rectilinear construction, at distances from one another which correspond to a multiple of the distance between the receiving compartments of the dispensers, for example a multiple which is greater, by 1, than the number of consecutive lines of receiving compartments, viewed in the direction of transport, of the medicament-dispensers which it is planned to provision. The best possible utilisation of the time for provisioning the medicament-dispensers, which is subdivided into cyclical intervals, corresponds to this arrangement.

On their lower side, the magazine shafts are delimited by a slide which forms, so to speak, the bottom of the shaft and by which the lowest standard blister pack in a stack in each case can be received, after a standard blister pack which has been previously emptied by provisioning operations is removed, under which circumstances the standard blister pack received by the slide can be pushed out again into the de-blistering and provisioning apparatus arranged outside the shaft.

The slides of the individual modules of the installation are constructed in two parts and have a plate-shaped guide part which is guided, so as to be displaceable forwards and backwards horizontally with respect to the transporting apparatus, at least within the particular magazine shaft, in guides which are arranged on the shaft-delimiting walls which extend parallel to one another, and also a frame part which permits form-locking reception of that standard blister pack in a stack which is lowest in each case, in such a way that the said blister pack cannot shift out of the frame part either laterally or in the direction of displacement, while said frame part must be moved, for de-blistering purposes, to the positioning for discharging the particular medicament.

This configuration of the installation according to the invention is distinguished by a particularly simple construction which also leads to high reliability of functioning, and the installation can be precisely adapted to the variety of medicaments necessary for provisioning medicament-dispensers, by adding or even removing installation modules with little expenditure in each case, a fact which ultimately leads to the shortest possible cycle times.

In a particularly simple embodiment of the installation modules which is reduced to the essential basic functions, said modules may be configured in such a way that calling at the distributing position at which the de-blistered medicament is dispensed to the medicament-dispenser takes place simply by the onward displacement of the standard blister pack beyond the de-blistering position by one receiving-compartment interval, which naturally presupposes that the cutting of the blister covering and the discharging of the medicament from the blister cup which has been made ready for opening can take place with the blister cup in the same orientation, something which is possible in any case if the standard blister packs are oriented in such a way that the blister caps are arranged so as to point downwards, and the cutting of the blister caps by means of the punching tool can likewise take place "from below" in this orientation.

In a preferred configuration of the installation modules according to the features in claim 2, the frame part of the particular slide is rotatable, relative to the—plate-shaped—guide part, by 180° about the common central longitudinal axis of the frame part and guide part in such a way that said frame part can be rotated, for example, out of an orientation in which the blister caps are arranged so as to point upwards and cutting or punching-out is possible "from above" by means of a vertically displaceable punching tool, and into an orientation in which said blister caps are arranged so as to point downwards, and the discharging of the particular medicament into the medicament-dispensers which are arranged "underneath it"—underneath the frame part—is possible, and takes place through the fact that the—upwardly pointing—bulges in the blister cups are acted upon by means of a die, under which circumstances the said blister cups are deformed and the medicaments are able to drop down while evading the parts of the blister caps.

In view of the great diversity of industrially produced types of standard blister packs, it is particularly expedient if the modules from which provisioning installations according to the invention can be erected can be adapted individually to the medicament blister pack used for distribution purposes, in order to guarantee reliable functioning of the particular module.

In connection with a configuration, which is provided for according to claim 3, of the magazine shafts of the installation modules as a C-profile arrangement which is open towards the direction of transport and in which the clear distance between narrow end faces, which point towards one another, of narrow, unattached profile legs is significantly smaller than the distance between mutually parallel profile-leg faces of the C-shaped shaft-profile arrangement which mediates the lateral guidance of standard blister packs, it is particularly advantageous if the distance between these lateral guide legs of the C-profile arrangement and/or the distance of vertical guide faces thereof from the said opposed, narrow guide-profile faces of the unattached, narrow profile legs that delimit the opening, can be adjusted in order to be able to adapt the guides for the stacked standard blister packs to their geometrical dimensions in a simple manner.

The installation, which is outlined by the features in claim 5 in terms of construction and principle of functioning, is expediently constructed in such a way, in the event of the standard blister packs comprising two or more rows of blister cups, that a number of punching tools that corresponds to the number of rows of blisters is provided, by means of which punching tools the blister caps of one of the rows of blister cups can be cut in each case, under which circumstances the punching tools can be actuated jointly, but that, for the purpose of discharging the de-blistered medicaments, separately actuatable discharging tools are provided so that the medicaments, whose blister packs have been jointly prepared for the removal of the medicaments, can be dispensed into the particular medicament-dispensers in chronological succession.

It is accordingly advantageous, for the purposes of a simple configuration of the installation, if, in accordance with claim 8, a common actuating drive is provided for the punching tools, and if, in accordance with claim 9, a drive for actuating the discharging tools which is capable of travelling between the discharging positions is present for the individual actuation of said discharging tools. A drum-shaped tool-carrier, which is configured and mounted in accordance with claim 10 and on which both punching tools for opening the blister cups and discharging tools for dispensing the de-blistered medicaments to the medicament-dispensers to be filled are arranged so as to be displaceable "vertically", that is to say perpendicularly to the course of the transport paths of the medicament-dispensers, is preferably configured in such a way that, as a result of the displacing positions of the slide of the particular installation module within mutually aligned guide grooves or apertures in the blister-pack shaft of the particular module, and of its tool-carrier, there is determined, within close tolerances, the position in which alone the tool-carrier, for which the features of claim 12 indicate a configuration which is simple in terms of both design and control technology, can be rotated for the functionally suitable positioning and orientation of the punching tools and of the discharging tool which is used in each case.

The features in claim 13 indicate a method of mounting the drum-shaped tool-carrier with the aid of rollers which roll along, so to speak, on the periphery of said tool-carrier and which are preferably provided in the arrangement according to claim 14.

Rollers of this type are able, as a result of a form-locking engagement of splines on the rollers, which splines have a radially projecting edge of an annular-disc-shaped bearing part of the drum-shaped tool-carrier, to mediate both smooth-running mounting and also reliable protection against axial dislocation of the tool-carrier, under which circumstances the rotatory drive of said tool-carrier, which is required for changing the latter over from the de-blistering position into the discharging position, may be constructed, according to claim 16, so as to act upon only one of the rollers and, if necessary, driving coupling of all the rollers can be realised by means of a driving belt which wraps around said rollers and can be kept under elastic tension.

In accordance with the features of claims 17 and 18, the installation according to the invention can also be designed in a simple manner in such a way that medicament-dispensers, which contain a patient's weekly requirement, arranged according to the ingestion times and days, can be provisioned in an efficient manner.

BRIEF DESCRIPTION OF THE DRAWINGS

Further details of the installation according to the invention emerge from the following description of specific configurations thereof with the aid of the drawings, in which.

DETAILED DESCRIPTION

Figure 1:
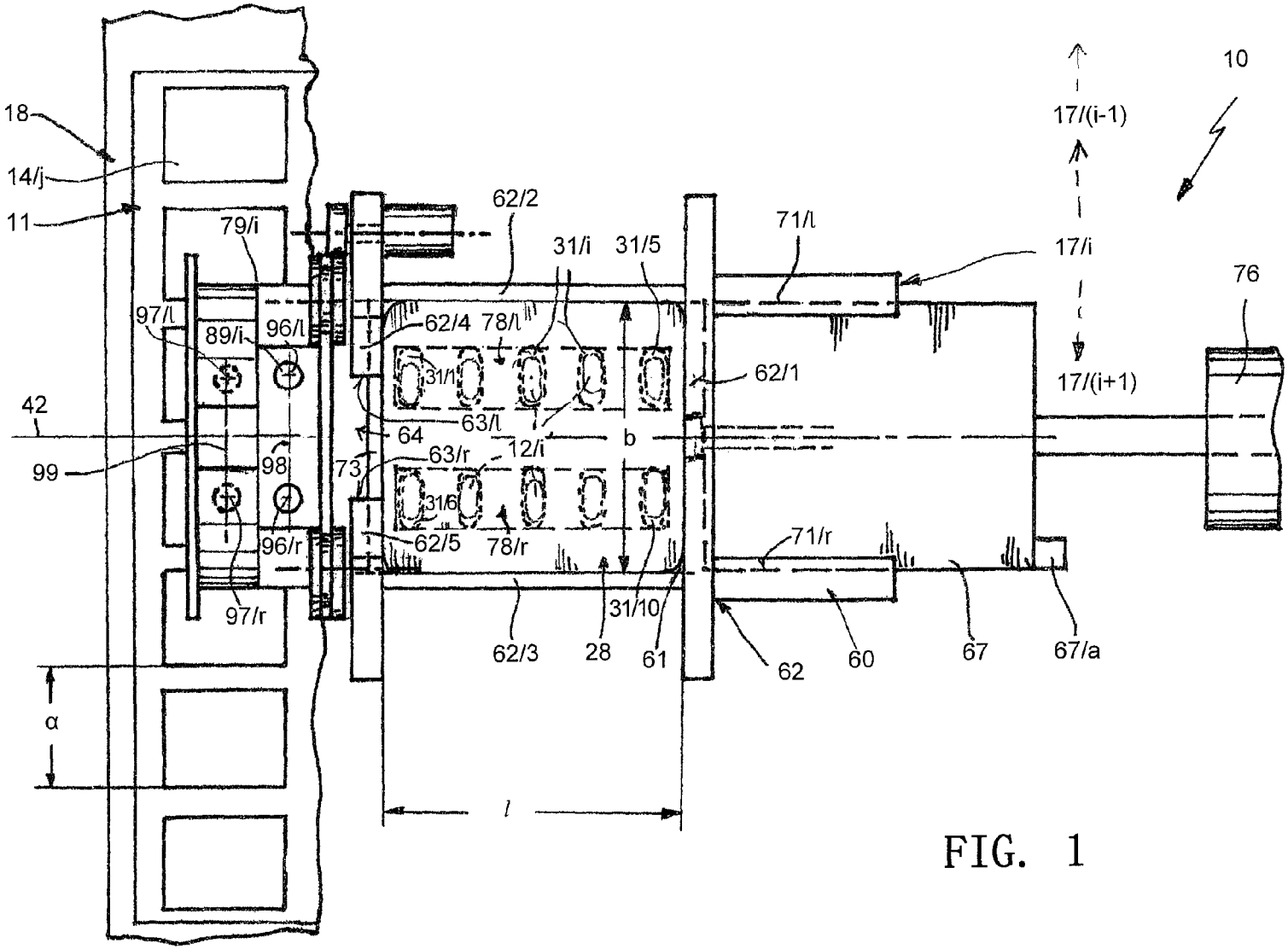
FIG. 1 shows the basic construction of an installation according to the invention for the person-related provisioning of medicament-dispensers with medicaments, in a diagrammatically simplified plan view.

The installation, which is designated as a whole by 10 in FIG. 1, is intended for the provisioning of medicament-dispensers 11 which contain, as required, the medicaments which are to be taken daily or weekly by a patient in the quantity and sequence that fit the prescription, under which circumstances the particular medicament-dispenser 11 is, for its part, constructed in the manner of a blister pack or can be realised in a manner structurally similar to such a pack.

The installation 10 comprises provisioning modules 17/*i* which are assigned individually to the various medicaments 12/*i* with which it is to be possible to provision—in the most varied combinations—the medicament-dispensers 11, and which provisioning modules are arranged along a transporting apparatus which is designated, as a whole, by 18 and by means of which the medicament-dispensers 11 can be supplied—serially—to the provisioning modules 17/*i* at which the distribution of the particular medicament 12/*i* into the receiving compartment 14/*j*, which is provided in the medicament-dispenser 11 in each case, takes place (j=1 to k; k=number of receiving compartments in the dispenser 11).

Cyclically-controlled operation is presupposed for the installation 10, under which circumstances the feeding of the medicament-dispensers 11 takes place in equal feeding steps which correspond to the distance a between consecutive receiving compartments (14/*j*) and, viewed along the transporting apparatus 18, the distance between consecutive provisioning modules 17/*i* corresponds to an integral multiple of the width of the transporting step or the distance between the receiving compartments 14/*j*.

The exemplified embodiment which has been chosen for explanation purposes presupposes a straight "linear" configuration of the transporting apparatus 18, however other path movements, which are, for example, circular in certain sections or extend at an angle, and lead to and fro with respect to a main direction, are also possible and can expediently be used, according to the spatial conditions.

The provisioning modules 17/*i* are designed to the effect that they are able to receive a stock of standard blister packs 28 of the particular medicament 12/*i*, which packs are arranged in a stack 27 (FIG. 2*a*) in the particular module and mediate—in a manner which is controlled to suit the requirements—de-blistering and separation of the medicaments 12/*i* and also their distribution to the medicament-dispensers 11, that is to say the particular provisioning module mediates the complete sequence—with the exception of the onward transport of the dispensers 11 for the medicament assigned to it in each case—of the individual functions and can therefore be realised as a, so to speak, interchangeable unit of the provisioning installation 10, which can thus be adapted in a simple manner to the variety of medicaments to be processed in each case.

Figure 2A:
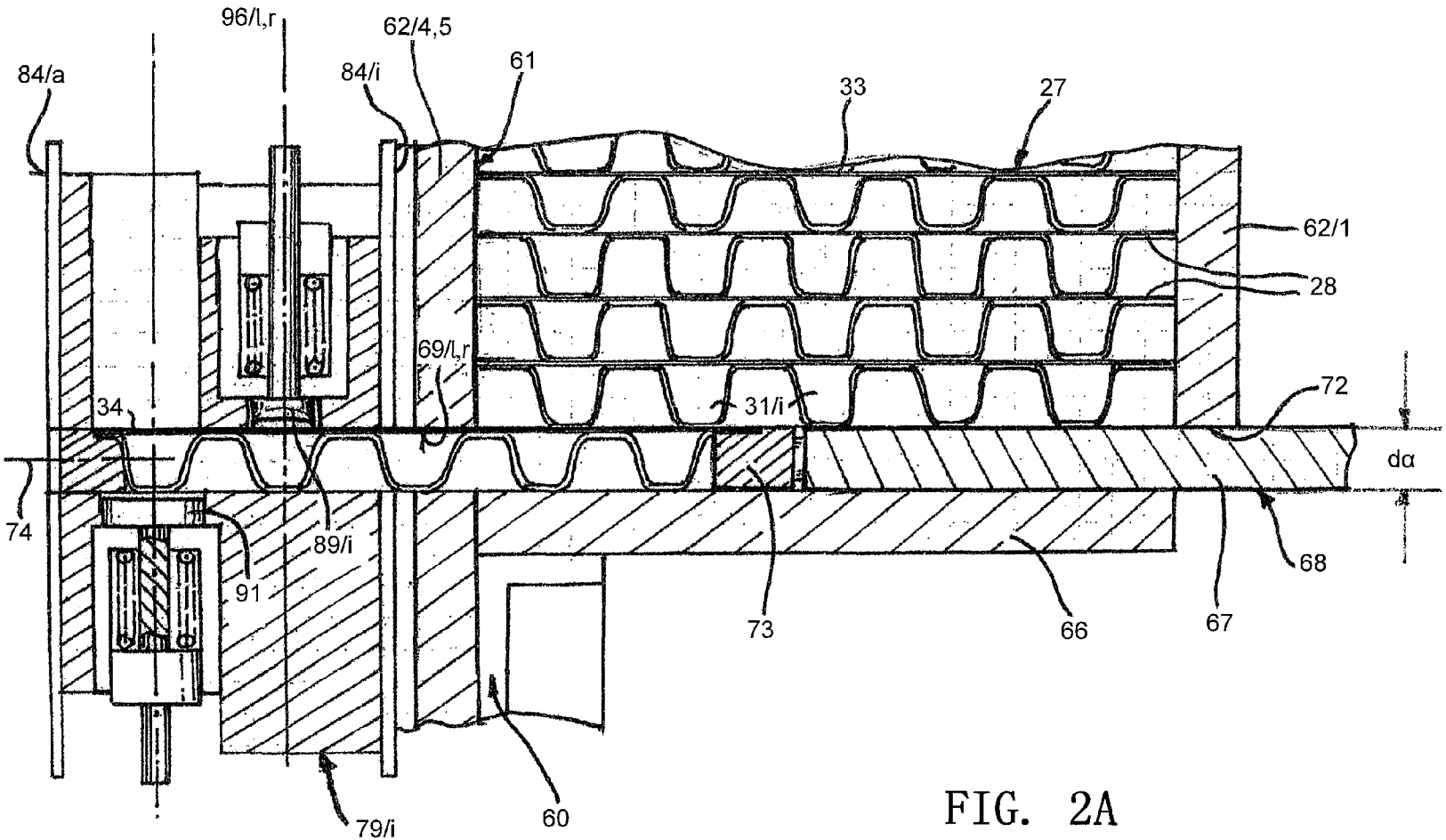
FIG. 2*a* shows a section along the line IIa-IIa in FIG. 1 for the purpose of representing details of an installation module which is suitable for constructing the installation according to FIG. 1 and which has a rotatable, drum-shaped tool-carrier.

For a more detailed explanation of the construction and functioning of the provisioning modules 17/*i*, reference will now also be made to the details in FIG. 2*a* that relate to this:

The provisioning modules 17/*i* arranged along the transporting apparatus 18, which may be realised in the manner of a conveyer belt, each have a "vertical" shaft 61 which is firmly but detachably mounted on a frame 60—the latter only being outlined diagrammatically in FIG. 2*a*—and receives a stock of one of the medicaments 12/*i* which are intended for provisioning purposes and are contained in standard blister packs 28 which, for their part, are arranged in a vertical stack 27.

In the explanatory example represented in FIG. 2*a*, these standard blister packs 28 are arranged in such a way that, when the sheets of the blister packs extend horizontally, their domed cups 31/*i*, which contain the individual medicaments, are arranged so as to point downwards, under which circumstances they are supported, by means of the cups 31/*i* in each case, on those flat regions of the sheets which border the apertures of the blister cups but which are covered by the blister film 33 when the standard blister packs 28 are in their initial state.

In the representation in FIG. 1, the shaft 61 is represented by an "upright" C-profile arrangement 62 which has longitudinal legs 62/2 and 62/3 adjoining a broad yoke-type leg 62/1 at right angles, and also two narrow guide legs 62/4 and 62/5 which jut out at right angles from the unattached sides of the longitudinal legs 62/2 and 62/3 and point towards one another and which are arranged opposite the yoke-type leg 62/1 and are markedly narrower than the latter, so that they delimit, with their narrow longitudinal end faces 63/*l* and 63/*r*, a vertical longitudinal slot 64 in the shaft profile 62, through which slot access can be gained, if necessary, to the standard blister packs 28 contained in the shaft 61.

The clear distance b of the longitudinal legs 62/2 and 62/3 of the shaft profile 62 from one another and the clear distance l of the narrow guide legs 62/4 and 62/5 from the yoke-type leg 62/1 of the shaft profile 62 correspond, apart from a small oversize which is necessary for the smooth-running displaceability of the standard blister packs, to the particular breadth b and particular length l of the standard blister packs 28 which can be stacked in the particular shaft 62.

In the explanatory example represented, the shaft profile 62 is closed off, at its underside that faces towards the frame 60, by a base plate 66 on which there is supported, in a manner capable of sliding movement, a plate-shaped guide element 67, which is rectangular in its basic shape, of a slide which is designated, as a whole, by 68 (FIG. 2*b*) and which guide element is guided, in a horizontally displaceable manner, between lower marginal end faces 69/*l* and 69/*r* of the narrow guide legs 62/4 and 62/5 (FIG. 2*a*) and lower marginal steps 71/*l* and 71/*r* on the lateral longitudinal legs 62/2 and 62/3 of the shaft profile 62, and also between the base plate 66 and the lower edge 72, which is arranged at a distance from the latter, of the yoke-type leg 62/1 of the shaft profile 62.

The slide 68 further comprises a frame part or window part 73 which is likewise in the form of a flat plate in its outer configuration and which has the same breadth b as the guide element 67 and also the same "vertical" thickness d as the latter, and is guided, together with the latter, in a slidingly displaceable manner in the aforesaid guide elements on the shaft, that is to say essentially between the marginal steps 71/*l* and 71/*r* on the C-profile 62 of the shaft.

The frame part 73 is connected to the guide element 67 so as to be rotatable about a central longitudinal axis 74 of the latter, the central longitudinal axis of said frame part 73 being in alignment with the central longitudinal axis 74 of said guide element 67.

By means of a driving apparatus 76, which is merely outlined diagrammatically and may be constructed in the manner of a spindle drive with an electric driving motor, the slide 88 can be shifted out of the shaft profile 62 from an inner end position, in which the frame part 73 is arranged completely inside the C-shaped shaft profile 62, to an extent such that said frame part 73 can be rotated about the central longitudinal axis 74 of the plate-shaped guide part 67 (FIG. 4*c*) "outside" the narrow guide legs 62/4 and 62/5 that point towards one another.

When the slide 68 is in the inner end position (FIG. 1), the downwardly domed blister cups 31/*i* of the bottommost standard blister pack, in each case, which is arranged in the particular shaft are able to drop into window clearances 77/*l* and 77/*r* in the frame part 73 and thereby pass into engagement, with fluidity of shape, with the edges of the said window clearances 77/*l* and 77/*r*, so that, when a subsequent pushing-out of the frame part 73 occurs, the standard blister pack held on said frame part 73 is, so to speak, entrained, and the standard blister pack which is then shifted after it from above can initially be supported in a sliding manner on mutually adjacent marginal regions of the frame part 73 and guide element 67 and, after said frame part has been completely pushed out of the C-shaped shaft profile 62 (FIG. 4*c*), only rests, thereafter, on the plate-shaped guide element 67 which, in the end position which is reached in these circumstances, covers the base plate 66 of the shaft 61.

In the exemplified embodiment which is represented for explanation purposes, the two window apertures 77/*l* and 77/*r* of the frame part 73, which are rectangular in their basic shape, each define, so to speak, the envelope of the outer contours of two rows 78/*l* and 78/*r* (FIG. 1) of blister cups belonging to the particular standard blister pack, the said rows comprising five blister cups in each case in the exemplified embodiment represented.

For the purposes of contamination-free removal of medicaments 12/*i* from the standard blister packs 28 and the introduction of the "de-blistered" medicaments into the medicament-dispensers 11 which are to be provisioned, the individual provisioning modules 17/*i* are provided, for the purpose of opening the blister cups, with punching or scratching tools 89/*i* which are adapted to the medicaments 12/*i*, and also with discharging tools 91 for discharging the particular medicaments from the blister cup which has been prepared for opening, which tools are arranged so as to be movable within drum-shaped tool-carriers 79/*i* which are assigned to the provisioning modules 17/*i* individually and which, for their part, are functional elements of the medicament-related provisioning modules 17/*i*.

The particular drum-shaped tool-carrier 79/*i* (FIG. 2*a*) is arranged on that outer side of the narrow guide legs 62/4 and 62/5 bordering the vertical longitudinal slot 64 in the shaft profile 62 which faces away from the yoke-type leg 62/1 of the C-shaped shaft profile 62, and is mounted on said guide legs so as to be rotatable about a shaft 74/*t* (FIG. 2*c*) which is integral with the casing and coincides with the central longitudinal axis 74 of the slide 68 when the latter is in its functioning position inside the provisioning module 17/*i*.

The drum-shaped tool-carrier 79/1 has a central, slot-shaped through-duct which is delimited, at the end faces 84/*a* and 84/*i* of the said tool-carrier, by the edges of rectangular apertures 86 whose clear dimensions b/t and d/t correspond, apart from a small oversize, to the breadth b/f and thickness d/f (FIGS. 2*a*, 2*b*) of the frame-shaped and plate-shaped carrier element of the slide 68.

In the case of the basic construction of the installation 10 which has been explained thus far, the basic functions necessary for de-blistering standard blister packs and also for provisioning the medicament-dispensers can be implemented as will be explained below. In doing so, the starting point adopted will be that an electronic control apparatus which is necessary for controlling these functions can be readily realised by a person skilled in the art, when these functions are known, because of his specialist knowledge, and that it is therefore possible to dispense with an explanation in this regard.

For explanation purposes, it will be assumed that the provisioning module 17/*i* under consideration is designed for, and together with, a stock of standard blister packs 28 which have, in each case, two rows 78/*l* and 78/*r* of five blister cups 31/*i* each (l=1 . . . 10).

For the purpose of explaining a typical provisioning cycle, as a result of which a medicament 12/*i* passes into the selected receiving compartment 14/*i* in a medicament-dispenser 11 which is to be provisioned in the provisioning module 17/*i* in question, the starting point adopted will be the "basic" position which is represented in solid lines in FIG. 1 and which is obtained if, after the medicaments 12/*i* in a standard blister pack 28 have been completely "used up" and the latter has been removed, the slide 68 has traveled back, after the provisioning operation, into the shaft of the provisioning module 17/*i*-through the tool-carrier 79/*i* which can be driven in a rotatory manner—into that position in which the frame part 73 of the slide 68 is able to receive the bottommost standard blister pack in the stack 28.

In this shifting-in position, the arrangement of the standard blister pack 28 within the frame part 73 of the slide 68 is defined in a form-locking manner through the fact that the bulges of the blister cups abut against the outer longitudinal edges 87/*al* and 87/*ar* of the window clearances 77/*l* and 77/*r* in the frame part 73, and preferably also against the inner longitudinal edges 87/*il* and 87/*ir* of the rectangular window clearances, as a result of which the standard blister pack 28 is secured against lateral shifts, that is to say ones which take place transversely to the vertical longitudinal central plane of the provisioning module 17/*i*, and is secured against axial shifts, that is to say ones which are directed parallel to the track of the vertical central plane 42 (FIG. 1) of the provisioning module 17/*i*, as a result of the abutment of the terminal blister cups 31/1 and 31/5, and also 31/6 and 31/10, of the two rows of blister cups 78/*l* and 78/*r*, against the narrow transverse edges 88/*lv* and 88/*lr* and also against the rearward transverse edges 88/*lb* and 88/*rb* (FIG. 2*b*) of the frame apertures 77/*l* and 77/*r*.

Figure 2C:
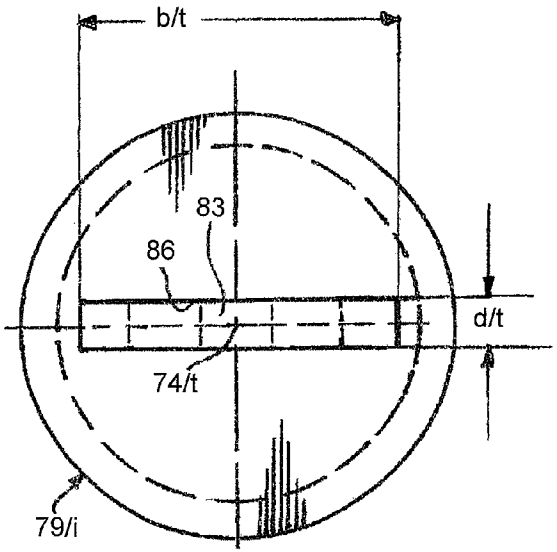
FIG. 2*c* shows a view of the tool-carrier according to FIG. 2*a*, in the direction of the arrow IIc in FIG. 2*b;*

In this basic position, in which the frame part 73 is located, viewed in the axial direction, between the yoke-type leg 62/1 and the narrow guide legs 62/4 and 62/5 of the C-profile 62 of the vertical shaft 61, the frame part 68 is shifted out to such an extent, that is to say completely out of the through-duct 83 in the drum-shaped tool-carrier 79/*i*, which through-duct is rectangular, as shown in the end view in FIG. 2*c*, that said frame part can be rotated about the central axis 74/*t* of the drum, which coincides with the central longitudinal axis 74 of the slide 68.

When the slide 68 is in the basic position, which has been explained thus far, its plate-shaped guide element 67 is arranged essentially outside the shaft profile 62 and is thereafter only guided, in a non-twistable manner, in a short end-face end section, which faces towards the frame part 73, within the rectangular aperture in the yoke-type leg 62/1, the lateral guide edges of which aperture are in alignment with the guide edges of the narrow guide-profile legs 62/4 and 62/5.

Also corresponding with the basic position of the slide 68, of which an explanation has been given, is a basic position of the drum-shaped tool-carrier, which position is defined by the fact that the longitudinal edges of the through-duct 83 in the tool-carrier 79/*i* of the slot-shaped through-duct 83 extend "horizontally", that is to say extend parallel with the longitudinal edges of the slot-shaped clearance in the yoke-type leg 62/1 of the C-profile 62, and the frame part 73 of the slide 68, and optionally also the plate-shaped guide element 67 of the slide, therefore pass, by means of an "outer" end section, through the through-duct 83, or at least are able to pass a certain distance into the latter.

The basic position of the slide 68 which has been described may expediently be defined by a striking action of the slide with an element integral with the framework, for example of the rectangular-plate-shaped guide element 67 with a diagrammatically illustrated stop 67/*a* (FIG. 1) which is integral with the framework and which may be configured so as to be adjustable/lockable, viewed in the direction of displacement of the slide 68, in order to be able to adapt the basic position of the slide to various sizes of standard blister packs.

Figure 3A:
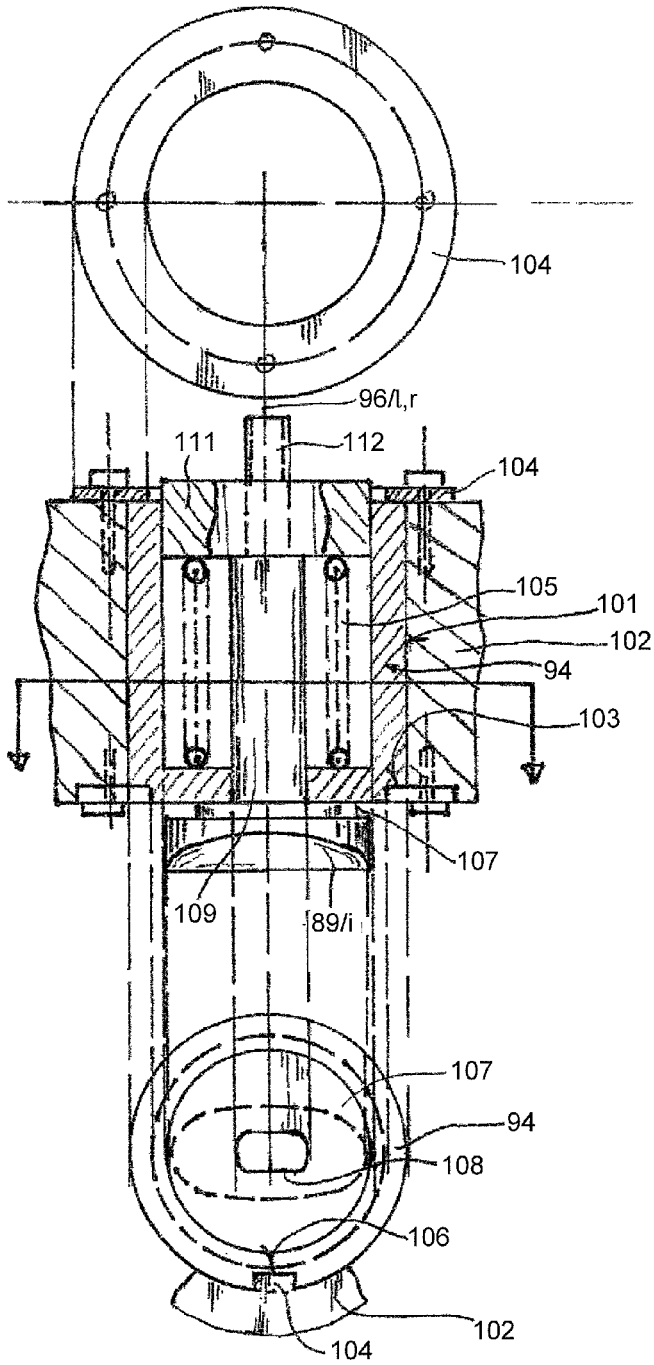
FIG. 3*a* shows details of a punching tool and of a tool-holder, which is suitable for mounting said tool displaceably on the tool-carrier and can be inserted in the latter, in a plane that contains the central axis of said holder.
Figure 3B:
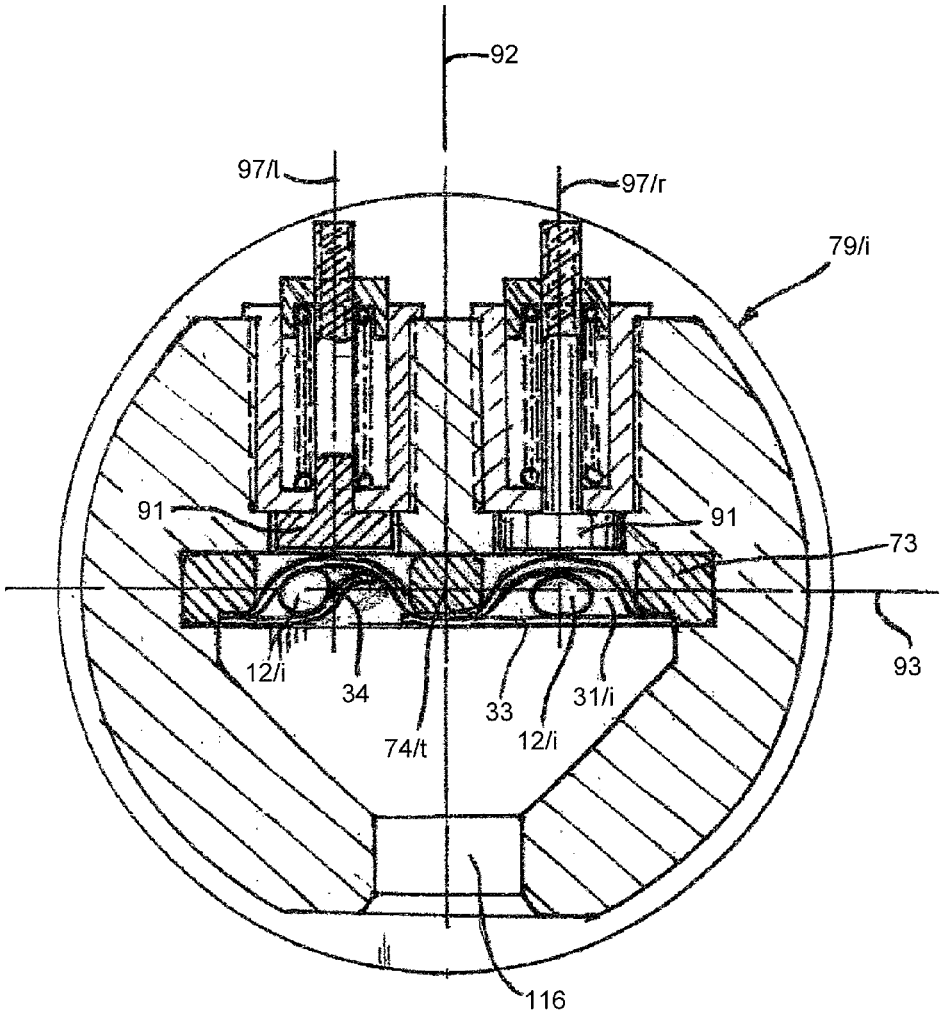
FIG. 3*b* shows a preferred configuration and arrangement of a pair of discharging tools belonging to a tool-carrier of an installation module, which pair of tools is designed for the de-blistering of dual-row standard blister packs and the alternating dispensing of medicaments from the cups of the said rows of blisters.

The drum-shaped tool-carrier 79/*i*, for explaining which reference will now also additionally be made to the detail representations in FIGS. 3*a* and 3*b*, is equipped, in a manner corresponding to the number of rows of blisters in the particular standard blister pack 28 in the exemplified embodiment which has been chosen for explanation purposes, with two punching tools 89/*i* (FIG. 3*a*) and also with two discharging tools 91 (FIG. 3*b*) which are assigned to the blister cups belonging to one row, in each case, of the rows 78/*l* and 78/*r* of blister cups.

Figure 2B:
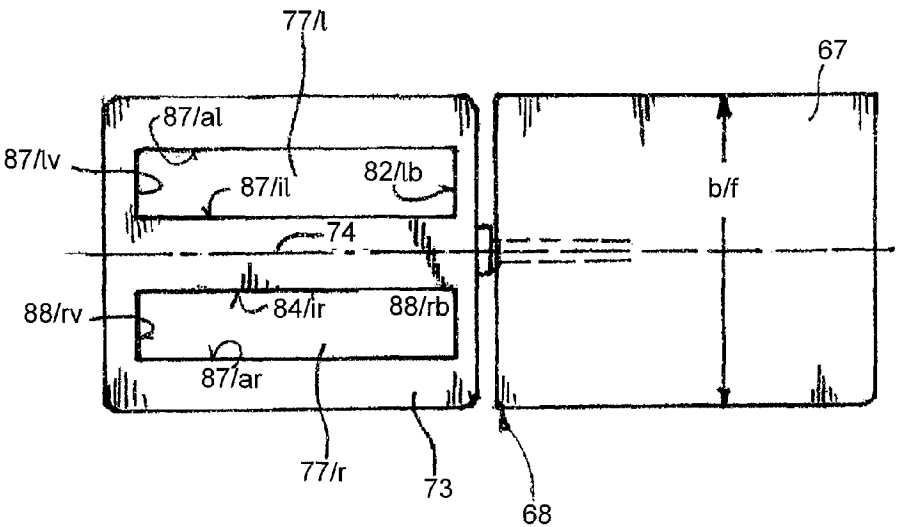
FIG. 2*b* shows the rotatable, drum-shaped tool-carrier, which is equipped with punching tools and also with discharging tools, of the module according to FIG. 2*a*, in a section along the line IIb-IIb in FIG. 2*a;*

These tools 89/*i* and 91 are arranged symmetrically with respect to a plane 92 (FIG. 3*b*) which contains the central axis 74/*t* of the drum-shaped tool-carrier 79/*i* and which extends, when the tool-carrier 79/*i* is in the basic position in which the longitudinal edges of the apertures 86 in the through-duct 83 extend parallel to the large-area delimiting faces of the plate-shaped guide element 67 of the slide 68, in the longitudinal central plane 42 (FIG. 1) of the provisioning unit 10, under which circumstances, viewed in this basic position, the punching tools 89/*i* are intercalated above the transverse central plane 93 of the tool-carrier 79/*i* and the discharging tools 91 are intercalated below the said transverse central plane 93 (FIGS. 2*b*, 2*c*).

The punching tools 89/*i* are adapted to the shape of the blister cups 31/*i* in such a way that the punching contours or the lines, along which a series of perforating holes is obtained by means of the punching tools, extend at a slight distance from the edges of the blister-cup apertures 16/*i* within the said edges of the apertures, so that the blister caps 34 which cover the apertures of the blister cups 31/*i* are left still hanging from marginal regions of the blister film 33 after the ramming operation, but bridges which are still present can be torn off without appreciable expenditure of force in the course of the discharging operation, although marginal regions, via which the blister caps 34 are still cohering with the adjoining blister film 33, are still retained, so that the blister caps 34, which remain connected in this way to the blister film 33 in hinge-like fashion, cannot pass, together with the medicaments, into the receiving compartments of the medicament-dispenser 11 which is to be provisioned.

Depending upon the shape of the medicaments, to which the shape of the blister cups 31/*i* is also adapted, the punching tools are configured in such a way that, in the case of a circular shape of the blister caps for example, said caps cohere with the blister film only via a narrow tongue which has an angular extension of, for example, 30°, or in the case of medicaments of elongated construction, in such a way that the blister caps remain cohering with said blister film 33 along almost the entire longitudinal extension of a slot-shaped opening region.

The punching tools are expediently constructed in such a way that their punching die is arranged interchangeably on die-carriers 94 (FIG. 3*a*) by means of which the punching tools 89/*i* are guided so as to be displaceable within the tool-carrier 79/*i* and are arranged in a defined position and orientation with respect to the standard blister packs to be treated.

When the tool-carrier 79/*i* is in the orientation provided for the de-blistering operation, and also in the orientation provided for the discharge of the medicaments from the blister cups, the central axes 96/*l* and 96/*r* (FIG. 2*a*) of the punching tools 89/*i* and also the central axes 97/*l* and 97/*r* (FIG. 3*b*) of the discharging tools 91 extend vertically, in each case, on either side of the vertical central plane 42 of the provisioning module 17/*i* and stand perpendicularly on the horizontal plane which is defined by that bearing face of the plate-shaped guide part 67 (FIG. 2*a*) on which the stack 27 of blister packs is supported during the working operation, at least with part of its basal surface.

The "axial" plane 98 (FIG. 1), which is spanned by the two central axes 96/*l* and 96/*r* of the punching tools, on the one hand, and the "outer" axial plane 99 (FIG. 1), which is defined by the central axes 97/*l* and 97/*r* of the discharging tools 91/*i*, on the other hand, extend at right angles, in each case, to the central, vertical, longitudinal central plane 42 of the provisioning module 17/*i*, viewed with the latter in the working position. The distance between the two axial planes 98 and 99 obviously corresponds at least to the distance that exists between the particular blister cups within the rows of blisters 78/*l* and 78/*r*.

In the specific exemplified embodiment which has been chosen for explanation purposes, the die-carriers 94 (FIG. 3*a*) are constructed, in their basic shape, as cylindrical-pot-shaped sleeves which can be inserted, with a defined orientation with respect to the axial plane of the central bore axes with which the central axes 96/*l*/*r* of the particular tool-carriers 79/*i* coincide, in bores 101 (FIG. 3*a*) of the basic body 102, which is cylindrical, or cylindrical in certain sections, in its basic shape, of the particular tool-carrier 79/*i*, which is provided with the "rectangular" through-duct 83, wherein the die-carriers 94 are supported on a narrow, inner, radial annular shoulder 103 disposed on the transverse-duct side, and can be held in abutment with said annular shoulder 103 by means of a fastening ring 104 acting upon the opposite annular end face of the shell of the die-carrier 94, and can be secured in position in a detachable manner in the bore 101 (FIG. 3*a*).

For the purpose of fixing the particular die-carrier 94 in its receiving bore 101 so as to be oriented in a defined manner, there are provided, in the specific exemplified embodiment represented, projections on the annular shoulder 103 and indentations or clearances 106 in that outer marginal region of the shell of the sleeve which is close to the base, which can be brought into engagement reciprocally and are of complementary configuration. The tool 89/*i*, which is arranged on the outside of the base 107 of the sleeve is firmly connected, in a detachable manner, by means of a guide bar 109 that passes through an aperture 108 in the base 107 of the sleeve, to a flange-shaped guide ring 111 (FIG. 3*a*) by means of which said tool is guided in a slidingly displaceable manner on the inside of the tubular shell of the die-carrier—at a distinct distance from the base part 107 of the latter—under which circumstances the orientation of the punching tool 89/*i* is safeguarded through the fact that the guide elements, namely the guide bar 109 and the aperture 108, which are of complementary configuration but not rotationally symmetrical, secure said tool 89/*i* against twisting about the central axis 96/*l*/*r* of the tool-holder.

The guide elements and securing elements of the die-carrier, which are of complementary configuration, are obviously adapted to the shape of the standard blister pack to be processed, in such a way that non-destructive de-blistering of the medicaments is achieved.

The basic position of the punching tool 89/*i* is that position in which it abuts against the outside of the base 107 of the sleeve 94. The tool 89/*i* is thrust into this position of abutment by a pretensioned helical spring 105 which extends between the inside of the base 107 of the sleeve and the guide ring 111, which is arranged opposite and at a distance, which helical spring is supported against said sleeve base and guide ring in each case.

Rising up from the said guide ring 111 on the outside is a centrally arranged actuating ram 112 which is acted upon by an actuator which is provided for the punching-type actuation of the tool 89/*i* and is constructed as a linear drive and which may be constructed, for example, as a pneumatic cylinder or as a spindle drive but, for the sake of simplicity, is not specifically represented.

Adopting a configuration of installation modules 17/*i* having two punching tools 89/*i* and two discharging tools 91 (fig. b) for processing dual-row standard blister packs as the starting point, one actuator, which is arranged, for example, so as to be displaceable on the installation module 17/*i* in such a way that it permits individual actuation of the two punching tools, may be sufficient for actuating the punching tools 89/*i*.

On the other hand an actuator, by means of which the two punching tools of the particular installation module 17/*i* can be jointly actuated "simultaneously", is also possible, and this is expedient, at least if it is possible to start out from the fact that the two medicaments which are de-blistered simultaneously can be used at a brief chronological interval for provisioning a medicament-dispenser 11.

As distinct from the de-blistering operation, it is necessary, for the provisioning of receiving compartments 14/*i* and of medicament-dispensers 11 which are to be capable of being provisioned with medicaments in the installation 10, for the said provisioning operation to take place individually for each receiving compartment 14/*i*, a fact which requires, in the case of the exemplified embodiment chosen for explanation purposes, either one actuator for each discharging tool 91 or an actuator which is capable of travelling to and fro between the two discharging tools in a controlled manner.

With respect to their actuation and their mounting on the drum-shaped tool-carrier 79/*i*, the discharging tools 91 (FIG. 3*b*) may be realised in a manner largely similar to the punching tools, so that to that extent it is possible to dispense with a detailed explanation of said discharging tools. It should merely be noted that the discharging tools and the carriers containing them, which are similar to the tool-carriers 94 of the punching tools, may be of rotationally symmetrical construction with respect to the central axis, just so long as the discharging stroke of the discharging tools can be of sufficient dimensions to guarantee the departure of the medicaments from the blister cups which have been opened.

For the purpose of explaining a typical working cycle of one of the installation modules 17/*i*, reference will now additionally be made to FIGS. 4*a* to 4*d*. Adopting the configuration represented in FIG. 4*a* as the starting point, the medicament 12/*il*, which is arranged, for example, in the left-hand blister cup 31/*l*1 of that pair of blister cups of the standard blister pack already received by the frame part 73 of the slide 68 which is closest to the drum-shaped tool-holder 79/*i*, is to be dispensed into a receiving compartment of a medicament-dispenser 11. As represented in FIGS. 1 and 2*a*, the starting point adopted will be that starting position of the drum-shaped tool-carrier 79/*i* in which its punching tool(s) is/are arranged above the horizontal transverse central plane 93 of the installation module 17/*i*.

Figure 4A:
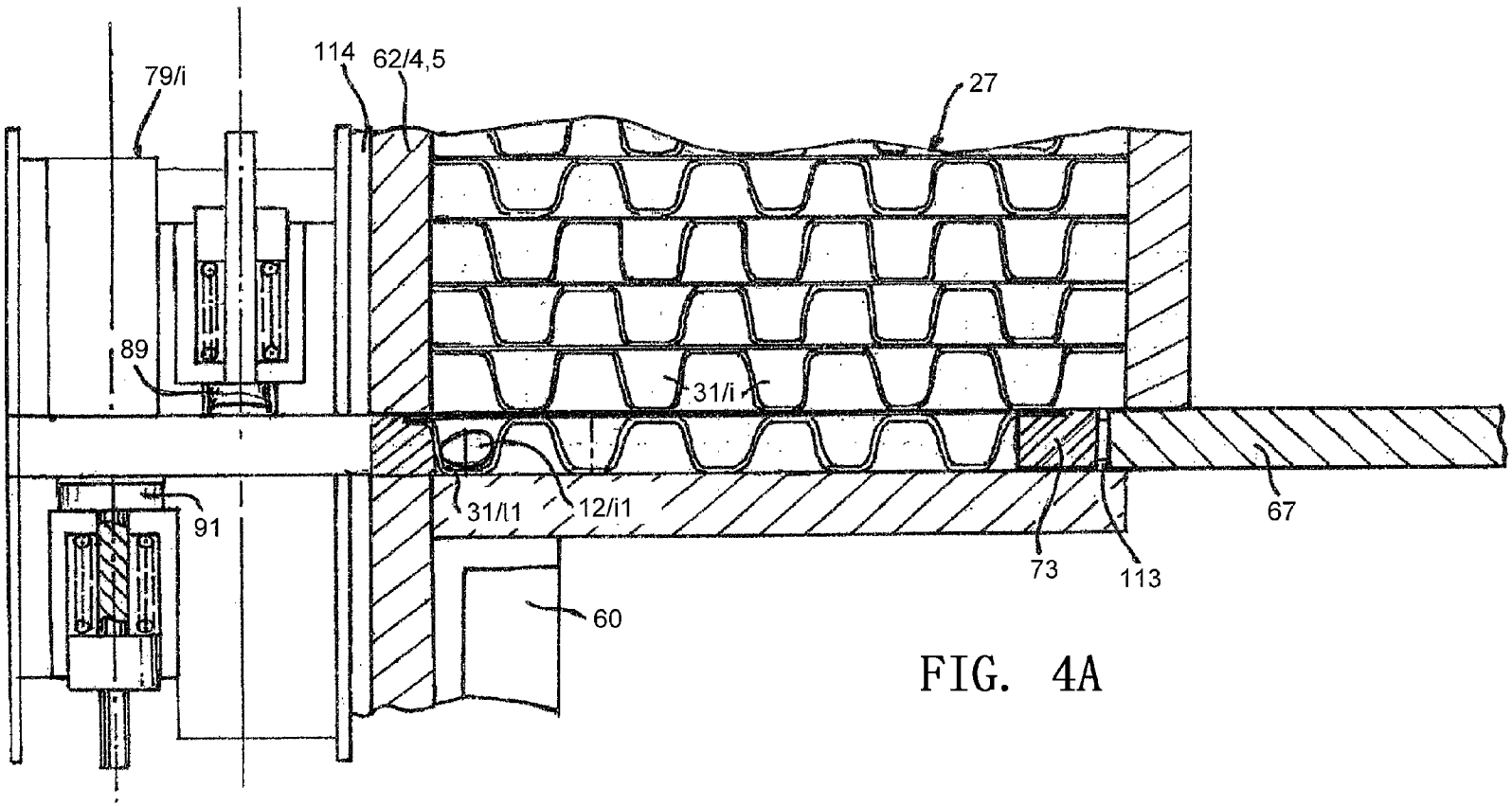
FIGS. 4*a*-4*d* show consecutive functioning positions of the module according to FIG. 2*a*, in a sectional representation that corresponds to the latter, for the purpose of explaining its functioning.
Figure 4B:
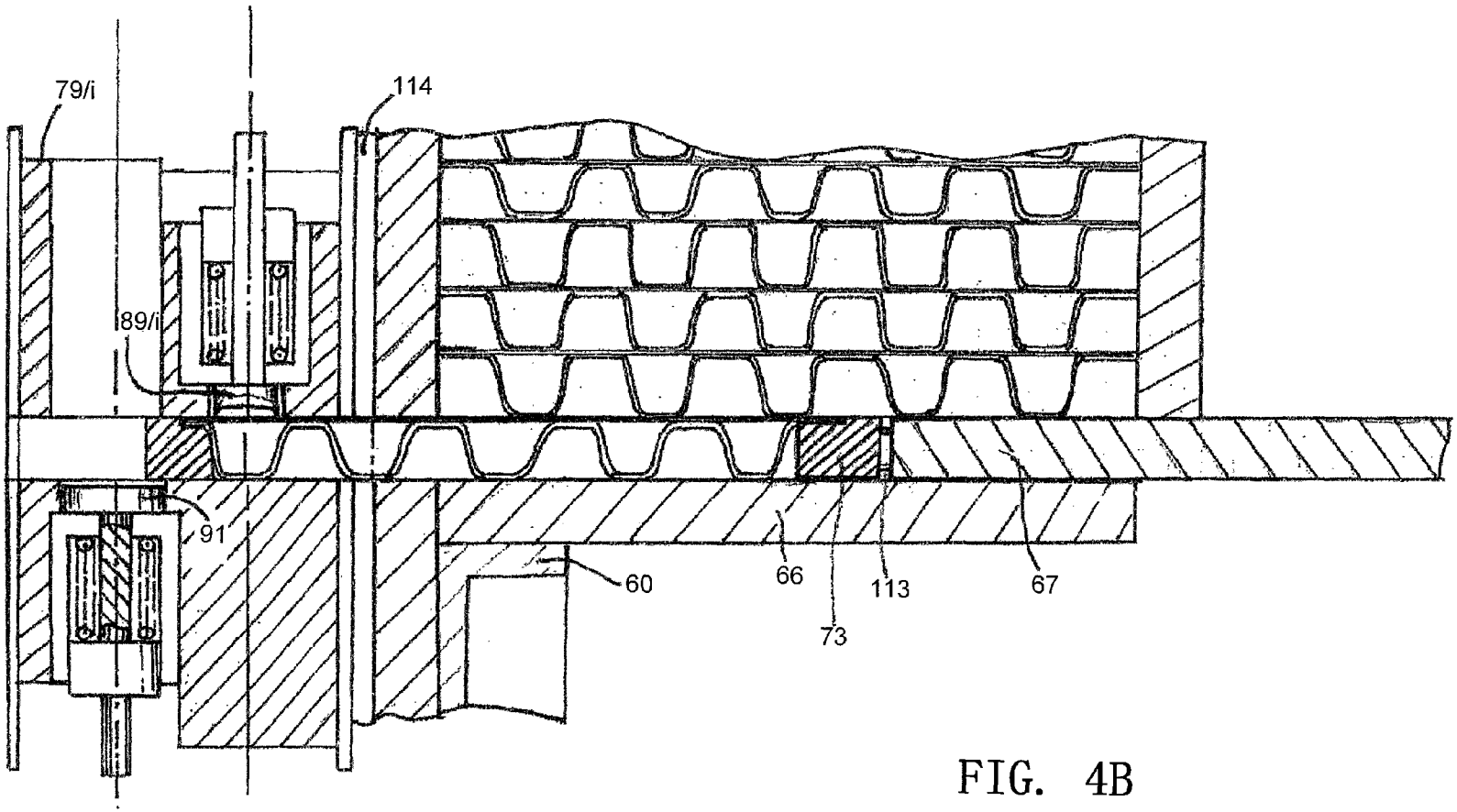
Figure 4C:
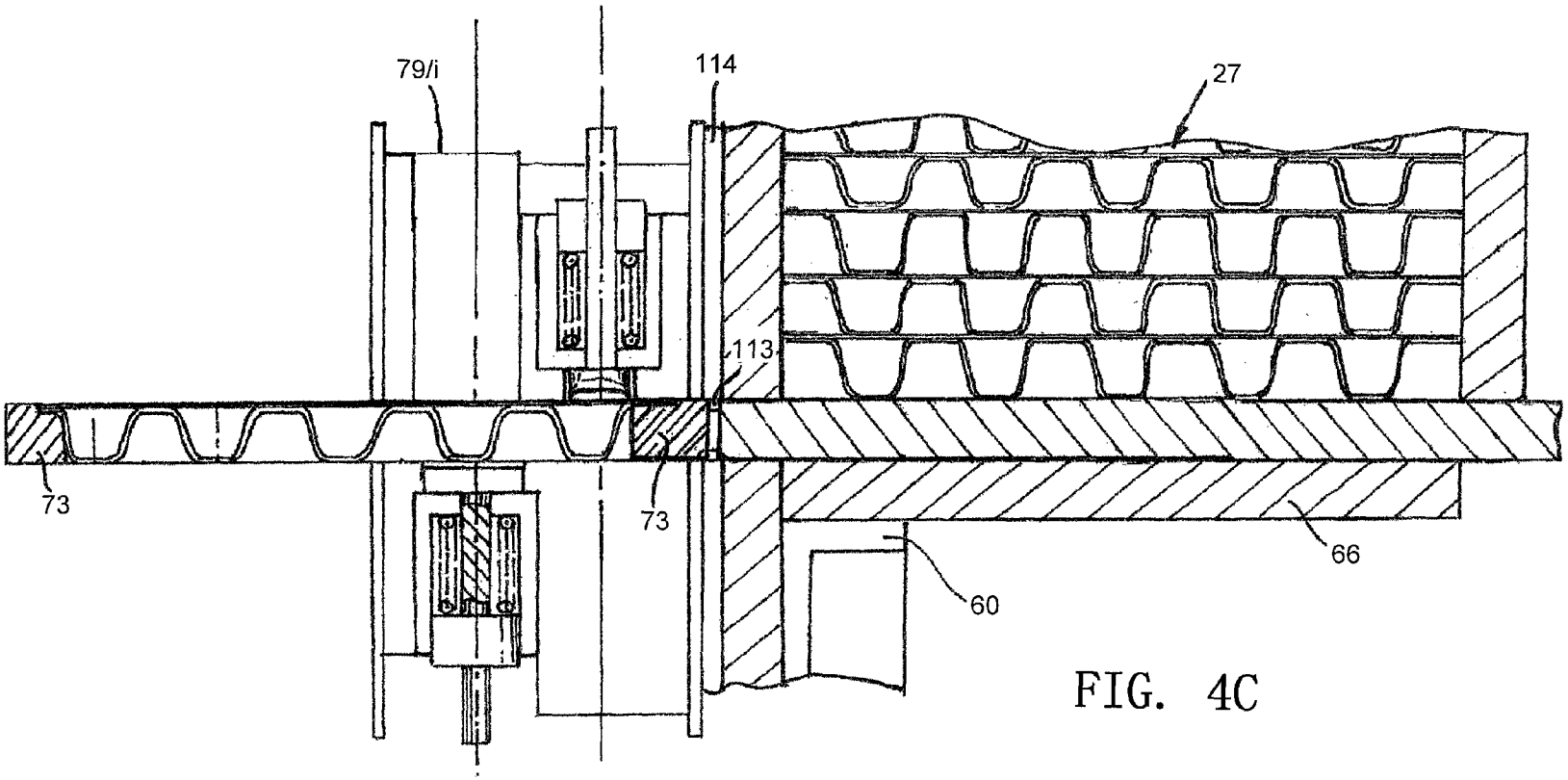
Figure 4D:
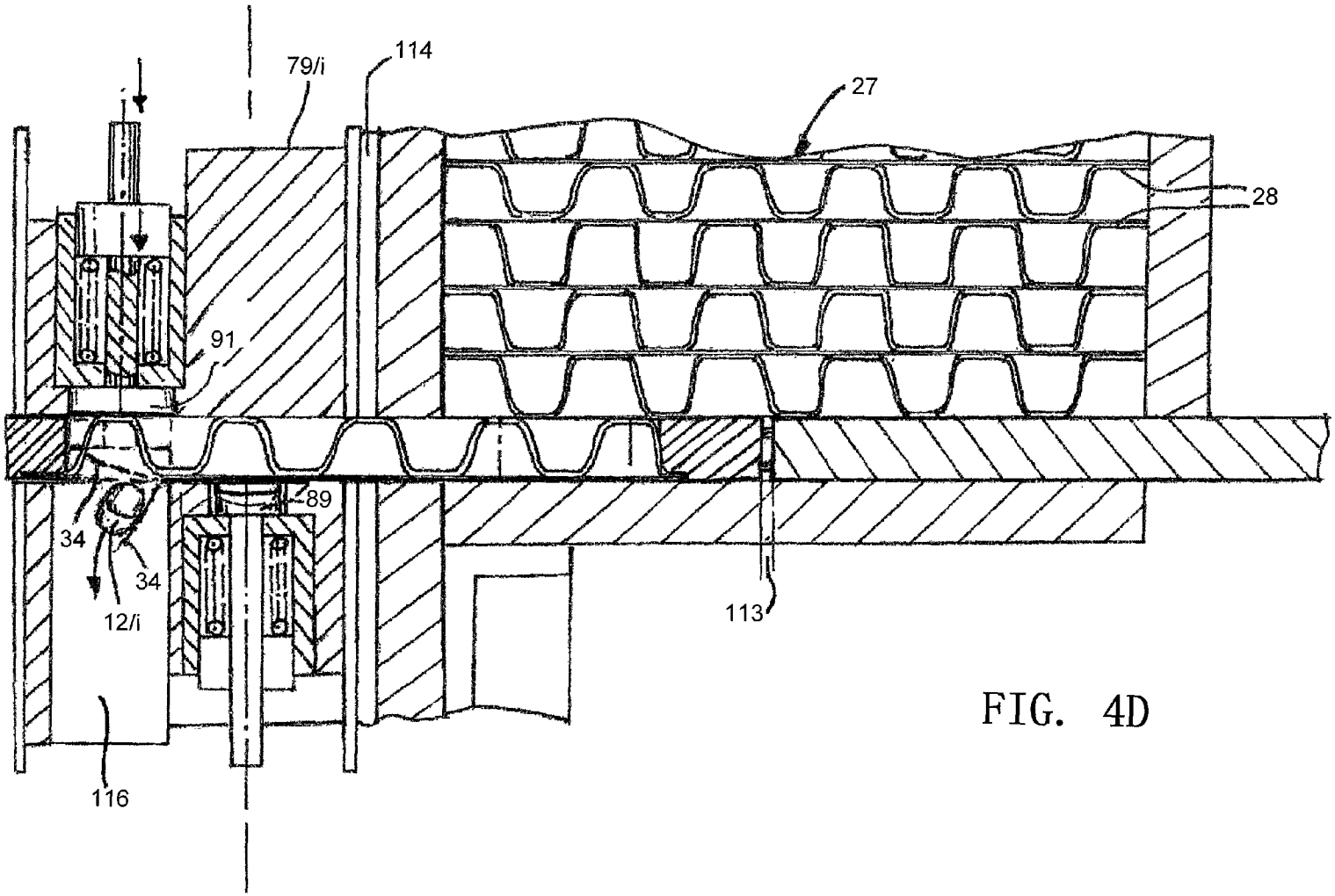

For this purpose, the slide 68 is first pushed into the position represented in FIG. 4*b*, in which the selected blister cup with its medicament 12/*il* is located underneath that punching apparatus which is to be actuated for the purpose of cutting the blister cap of the blister cup in question. After the said apparatus has been actuated, the slide 68 is pushed onwards until the gap 113, by which the frame-shaped guide part 73 is offset from the plate-shaped guide element 67, is located within, or arranged congruently with, that gap 114 which is left between the drum-shaped tool-carrier 79/*i* and those end faces of the narrow frame legs 62/4 and 62/5 pointing towards one another which face towards said tool-carrier, and consequently that position of the slide 68 is reached in which the frame part 73 can be twisted in relation to the plate-shaped guide part 67 which is arranged inside the C-shaped shaft profile (FIG. 4*c*).

After this rotation about the central longitudinal axis 74/*t* of the drum-shaped tool-carrier 79/*i* has been performed, a position is reached in which the discharging tool is now arranged above a drop-out shaft 116 in the drum-shaped tool-carrier 79/*i*, underneath which there extends the path along which the medicament-dispensers 11 to be provisioned are conveyed past the installation module 17/*i*.

After this, the slide 68 is pushed back towards its starting position again until the blister cup 31/*l*1 which has been opened is arranged underneath the discharging tool 91 (FIG. 4*d*) and, as a result of actuation of said tool, the medicament can be discharged into the ejection shaft 116 and can drop into that receiving compartment 14/*j* of the medicament-dispenser 11 which has already been positioned to catch it.

After the retraction—raising—of the discharging tool from its position of engagement with the part of the blister pack which has remained in the frame aperture 77/*l* or 77/*r*, the slide 68 is pushed back again into the starting position represented in FIG. 1, in which the drum-shaped tool-carrier 79/*l* is released again, so to speak, and can be rotated back into that starting position in which the punching tools are arranged above the transverse central plane 93 of the tool-carrier again, and the provisioning module 17/*i* is thus prepared for carrying out the next provisioning cycle.

The construction, which has been explained thus far, of a de-blistering and provisioning module 17/*i* of a provisioning installation 10 is suitable, first of all, for the automatic provisioning of medicament-dispensers of the kind which comprise receiving compartments, which are assigned to the ingestion times, for receiving a patient's daily requirement and accordingly have compartments which are arranged in a single row and to which the ingestion times: "morning", "midday", "evening" and "night" are assigned.

Installations of this type are naturally also suitable, in principle, for provisioning medicament-dispensers which contain the weekly requirement, that is to say, comprise the stock of medicaments which is contained in seven daily-requirement-dispensers. A simple realisation of such a "weekly-requirement"-dispenser is possible, for example, in the form of a cassette, such as the known Temmler cassette, or in the manner of a 7×4 blister pack, as described in the Applicant's earlier incorporated patent application DE 10 2005 047 429.2.

Figure 5:
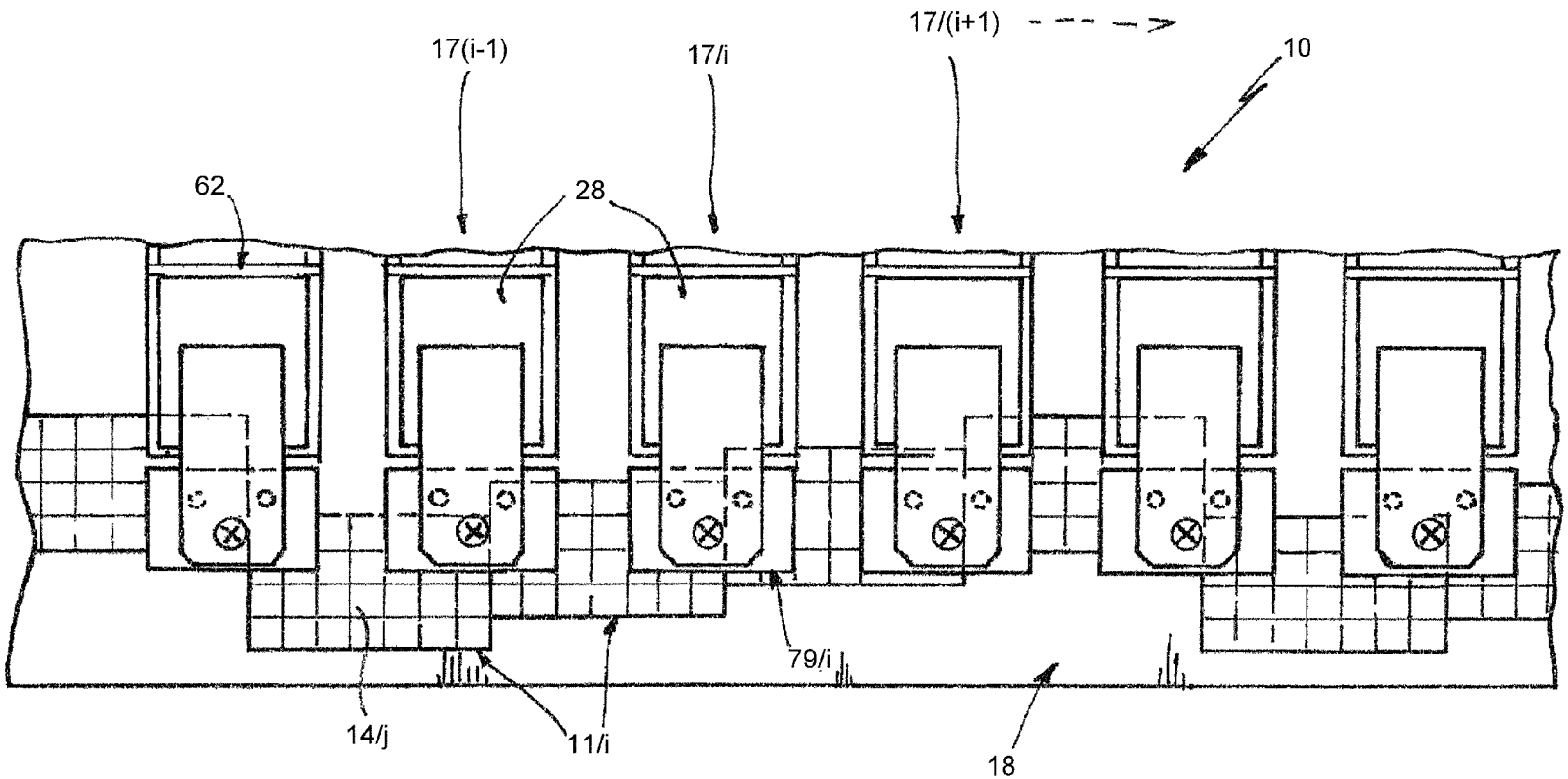
FIG. 5 shows, for the purpose of explaining a compact mode of construction for the entire installation, an arrangement and method for the transporting of medicament-dispensers, which arrangement and method are suitable for the operation of the installation according to FIG. 1 for provisioning purposes.

Reference will now be made to FIG. 5 for the purpose of explaining a particularly expedient configuration of an installation 10 which is suitable in this respect.

Essentially, the installation 10/5 according to FIG. 5 differs, with respect to its basic construction, from the installation 10 according to FIG. 1, only in the configuration and operation of the transporting apparatus by means of which medicament-dispensers containing a patient's weekly requirement are transported to the provisioning modules 17/*i* of the provisioning installation 10/5, which are arranged "serially" in the direction of transport but which work in a parallel manner—simultaneously—at least at times.

In the installation 10/5 according to FIG. 5, the consecutively arranged installation modules 17/*i* are arranged in such a way that the distributing apertures of their de-blistering stations are arranged at regular intervals from one another, under which circumstances the said distributing apertures of the provisioning modules and the clear cross-sectional dimensions of the apertures in the receiving compartments of the medicament-dispensers 110/*i* are coordinated with one another to the effect that, when the medicament-dispensers 11 are in the standstill phase, the perpendicular projection of the particular distributing apertures always lies within the apertures of the receiving compartments 14/*i*, so that it is ensured that medicaments passing out of the distributing aperture of the particular provisioning module always pass into the receiving compartment to be provisioned, which is "arranged underneath it", of the particular medicament-dispenser.

The step width and cycle of the transporting movements of the medicament-dispensers and also of the releasing operations of the distributing windows in the provisioning modules are likewise coordinated with one another in such a way that medicament-receiving compartments which pass into the opening region one after another can also be provisioned in a clearly correlated way.

It will be assumed, once again, that the relevant person skilled in the art is capable, on the basis of his technical knowledge, of implementing the measures which are necessary in this respect from the control technology point of view, and that more detailed explanations are not required on this subject.

Suppose the receiving compartments 14/*j* of the medicament-dispensers 11/*i* are arranged in a matrix-like manner in four time-of-day lines which are assigned to the daily ingestion times and seven day columns which are assigned to the days of the week, and that the transporting of the medicament-dispensers 11/*i* takes place in the direction of the mutually parallel time-of-day lines. Accordingly, there are predetermined, within the transporting region which leads over the entire installation from installation module to installation module, four paths of movement for the medicament-dispensers, in each of which one of the time-of-day lines of their receiving compartments is conveyed past the distributing apertures of the provisioning modules, via which the provisioning of the receiving compartments of the particular time-of-day line can take place.

In the specific explanatory example according to claim 5, the arrangement of the medicament-dispensers which succeed one another in each case is chosen in such a way that the time-of-day line that can be provisioned changes from dispenser to dispenser, for example in such a way that, after the receiving compartments of, for example, the night line of a "preceding" medicament-dispenser have been provisioned, the evening line of the following weekly medicament-dispenser to be provisioned is provisioned next and then, in the next weekly dispenser, the receiving compartments of its daily ingestion line and finally, in the next medicament-dispenser, the morning receiving compartments of the morning ingestion line—of the reference installation module 17/*i* under consideration—are provisioned, whereupon the night line of the next medicament-dispenser is provisioned, and so on.

So that provisioning, which meets the requirements, of the medicament-dispensers 11/*i* which have to be provisioned with very different combinations of medicaments is possible, the transporting apparatus must be configured and controllable in such a way that each of the receiving compartments 14/*i* of the medicament-dispensers 11/*i* has been conveyed precisely once past each of the provisioning apertures in the provisioning modules 17/*i*, before it is conducted out of the provisioning region and can be directed to the intended use for the patient.

This condition, which can be satisfied in manifold ways, is fulfilled, in the exemplified embodiment which has been chosen for explanation purposes, through the fact that the provisioning modules 17/*i* assigned to one medicament in each case are arranged at equal intervals from one another, which each correspond to an integral multiple, for example to seven times a feed-stroke stretch a, along a, for example, straight stretch along which the "multi-track"-"four-track"—transporting apparatus leads, and that the medicament-dispensers 11 are each guided four times along the said module arrangement and, in the process, are offset laterally, from one time to the next, by the breadth of their lines which are assigned to an ingestion time, so that, in each one of the passes that lead past the distributing stations, the receiving compartments which follow one another in the "morning", "midday", "evening"

and "night" lines, would be capable of being provisioned with one medicament, and therefore in a manner which meets the requirements.

In this type of provisioning, the situation arises, at the latest after a first complete pass, that is to say, after a medicament-dispenser has been transported along the module arrangement four times, that medicament-dispensers which have been provisioned continuously can thereafter be removed at an exit, although this naturally presupposes that new medicament-dispensers are constantly being supplied to the installation on the entry side and that the medicament-dispensers to be filled, which increasingly assume the provisioned state, are conducted through the installation without any gaps, so to speak.

The configurations of a provisioning installation 10 according to the invention that have been explained thus far are each designed for automatic operation, for controlling which there is provided a complex electronic control apparatus which, for the sake of simplicity, has not been represented but which generates, from a suitable system for processing patient-related information signals which contain the necessary information about the patients and the combinations of medicaments which they are to take and with which, in turn, the medicament-dispensers are to be provisioned to comply with prescriptions, the activating signals which are necessary for triggering medicament-selecting operations according to requirements, for de-blistering standard blister packs, for those movements of punching and discharging tools which are required for provisioning the medicament-dispensers, and also for controlling the rotating movements of tool-carriers and the displacing movements of blister pack-carriers.

These control signals are generated—expediently in a cyclically-controlled manner—in such a way that the transport and the various operations which are necessary, as a whole, for provisioning the medicament-dispensers can be synchronised in a simple manner.

In this instance, the patient-related data are stored in machine-readable form on data-carriers which are transported, in a spatially defined correlation with respect to the medicament-dispensers to be provisioned, by the transporting apparatus 18 together with said dispensers, and said data are already captured, with the aid of reading apparatuses with which the provisioning modules 17/*i* are, for their part, equipped, before they have to be usable for activating the individual functional units. In particular, it is expedient if the reading station is arranged, with respect to the distributing station it controls, to the effect that reading-in of the data is already possible, or takes place, before the medicament-dispenser 11 to be provisioned has arrived at the particular distributing station.

Furthermore, the medicament-dispensers are also expediently provided, for example in the region of their parts which border receiving compartments, with areas which can be printed on and on which there can be printed, by means of printing apparatuses which are associated with each of the provisioning modules 17/*i* individually but which are not represented, recorded particulars with the aid of which the provisioning of the particular medicament-dispensers can be duplicated, something which may prove important for reasons of error-protection or any analysis of errors that may possibly be necessary.

From the safety point of view, there are also provided—but, for the sake of simplicity, not represented—sensor apparatuses of the most diverse kind which serve as a checking apparatus and which continuously monitor the de-blistering of the standard blister packs and also the provisioning of the medicament-dispensers with the medicament units removed from said standard blister packs, under which circumstances the provisioning operations are expediently monitored quantitatively and not merely in a randomly sampled manner. In this case, use is made, in particular, of optical monitoring apparatuses which permit a checking operation that does not damage the medicaments. These safety apparatuses are also assigned to the installation modules 17/*i* individually.

The construction of the installation(s) 10 which has/have been explained thus far, from installation modules 17/*i* which are each assigned to a single kind of medicament, that is to say the "breaking-up" of the installation into the smallest possible units which are each capable of functioning individually, offers the greatest possible freedom with regard to the configuration of the topology of the installation, that is to say the routing of the transport path from the opening of the blisters, i.e. the introduction of medicament-dispensers into the transport region of the installation, as far as the conducting of the provisioned medicament-dispensers out of said installation. In this case, it is expedient if the entry and exit are arranged so as to be spatially adjacent to one another, under which circumstances flat-meander-shaped configurations of the transport path, and optionally also three-dimensional routings of the latter, are possible which allow, for the purpose of obtaining satisfactory utilisation of space, a mode of construction of the installation which is compact as a whole but offers the most extensive possible utilisation of space.

The invention claimed is:

1. An apparatus for personalized provisioning of medicament-dispensers the apparatus comprising:

a store for holding a plurality of different medicaments which are contained in standard blister packs in which a trough-shaped cup which is covered with a blister film is present for each of a plurality of administering units of medicaments, wherein the blister packs are arranged in vertical stacks in the store, and which are guided so as to be capable of sliding vertically, within magazine shafts which are respectfully assigned to various medicaments;

a de-blistering device scratching or cutting to facilitate an opening of the cover of one of the cups of the blister pack;

a transporting apparatus for positioning the medicament-dispensers at a delivery apparatus;

an electronic control unit which generates, from a system for processing machine-readable, person-related data which can be read and processed in a defined correlation with the transport of the dispensers, control signals to drive electronically controllable drives for the de-blistering device and the delivery apparatus;

a plurality of installation modules each having a blister-pack shaft, a punching apparatus and the delivery apparatus arranged so as to be capable of being mounted, along the transporting apparatus, at distances from one another which correspond to a distance between receiving compartments in the medicament-dispensers or to an integral multiple of the distance;

for each magazine shaft, a slide which receives a lowest blister pack in a respective stack, the slides structured to shift into a receiving position after one of the blister packs which has been emptied is removed, and structured to push the blister pack out of the position again and into a de-blistering and provisioning station;

in which:

the slides include a guide part, for horizontally displaceable guidance and a window part to receive the blister packs in a form-locking manner, the window part of the slide being rotatable, relative to the guide part, by 180° about a common central longitudinal axis of the slide; and in which:

the slides can be shifted out of the particular magazine shaft, transversely to the transporting apparatus of the medicament-dispensers, to an extent such that it is possible to carry out, in a de-blistering region, the scratching or cutting of the covering films of the blister packs, a removal of the medicament from the cup which has been opened, and a delivery of the medicament to the particular medicament-dispenser.

2. An apparatus according to claim 1,
in which
the magazine shaft is formed by a C-shaped shaft profile which is open towards the transporting apparatus and in which a distance between narrow end faces of narrow, unattached profile legs is significantly smaller than a distance between mutually parallel profile-legs of the C-shaped shaft-profile.

3. An apparatus according to claim 2,
in which
a distance between a lateral guide legs of the C shaped shaft profile is adjustable.

4. An apparatus according to claim 3,
in which
the punching apparatus is arranged in such a way that the blister packs can be transported, by outwardly directed displacement into the punching apparatus and by onward displacement beyond said punching apparatus, into a distributing station where a discharging of de-blistered medicaments into an assigned receiving compartment in the medicament-dispenser to be provisioned takes place.

5. An apparatus according to claim 4,
in which
the transporting apparatus is structured to allow the medicament-dispensers to be transported along a provisioning path along which each receiving compartment of the medicament-dispenser reaches the distributing station of each of the installation modules.

6. An apparatus according to claim 5,
in which
the provisioning path along which the medicament-dispensers reach the installation modules is routed, in a manner extending straight in certain sections and with a two-dimensional or three-dimensional course, in such a way that the provisioning path leads from a supply entry, at which the medicament-dispensers can be introduced, to an exit at which medicament-dispensers provisioned with medicaments are conducted out of the installation modules, extends within a surface region which is rectangular in its basic shape, or a number of such regions which are arranged one above the other.

7. An apparatus for personalized provisioning of medicament-dispensers the apparatus comprising:
a store for holding a plurality of different medicaments which are contained in standard blister packs in which a trough-shaped cup which is covered with a blister film is present for each administering units of medicaments, wherein the blister packs are arranged in vertical stacks in the store, and which are guided so as to be capable of sliding vertically, within magazine shafts which are respectfully assigned to various medicaments;
a de-blistering device scratching or cutting to facilitate an opening of the cover of one of the cups of the blister pack;
a transporting apparatus for positioning the medicament-dispensers at a delivery apparatus;
an electronic control unit which generates, from a system for processing machine-readable, person-related data which can be read and processed in a defined correlation with the transport of the dispensers, control signals to drive electronically controllable drives for the de-blistering device and the delivery apparatus;
a plurality of installation modules each having a blister-pack shaft, a punching apparatus and the delivery apparatus arranged so as to be capable of being mounted, along the transporting apparatus, at distances from one another which correspond to a distance between receiving compartments in the medicament-dispensers or to an integral multiple of the distance;
for each magazine shaft, a slide which receives a lowest blister pack in a respective stack, the slides structured to shift into a receiving position after one of the blister packs which has been emptied is removed, and structured to push the blister pack out of the position again and into a de-blistering and provisioning station;
in which:
the slides include a guide part, for horizontally displaceable guidance and a window part to receive the blister packs in a form-locking manner, the window part of the slide being rotatable, relative to the guide part, by 180° about a common central longitudinal axis of the slide; and in which:
the slides can be shifted out of the particular magazine shaft, transversely to the transporting apparatus of the medicament-dispensers, to an extent such that it is possible to carry out, in a de-blistering region, a scratching or cutting of the covering films of the blister packs, a removal of the medicament from the cup which has been opened, and a delivery of the medicament to the particular medicament-dispenser,
wherein the standard blister packs have two or more rows of blister cups, which extend in the direction of displacement of the particular standard blister pack,
and in which
a number of punching tools are provided that corresponds to the number of rows on the standard blister packs, and separately actuatable discharging tools are provided for discharging the de-blistered medicaments.

8. An apparatus according to claim 7,
in which
the punching tools and the discharging tools are arranged on a tool-carrier that can be mounted interchangeably on at least one of the installation modules.

9. An apparatus according to claim 8,
in which
a common actuating drive is provided for the punching tools.

10. An apparatus according to claim 7,
in which
the punching tools and the discharging tools are arranged on tool-carriers which are rotatably mounted on the shaft of the particular installation module which contains the respective stack of standard blister packs.

11. An apparatus according to claim 7,
in which
the punching tools and the discharging tools are mounted, so as to be displaceable at right angles to broad delimiting faces of a through-duct, on a rotatable, drum-shaped carrier which is secured against twisting when a frame-shaped slide part is in engagement both with a guide frame of the slide and with a displacing guide element of the shaft, and which is rotatable when the slide is either completely out of engagement with the carrier or is received by the latter to an extent such that it is no longer in engagement with the guide element of the shaft and a plate-shaped guide part of the slide does not protrude into the through-duct in the carrier, and rotation of the frame-shaped slide part in relation to the plate-shaped guide part is thus possible.

12. An apparatus according to claim 11, in which the tool-carrier is drum-shaped and mounted, by means of an annular-disc-shaped bearing element, an edge of which is acted upon in a form-locking manner by rollers rotatably mounted on the shaft of the particular installation module so as to be rotatable about the central axis of the plate-shaped and frame-shaped slide elements, and can be driven by means of its own rotatory drive, for the purpose of performing a 180° rotation.

13. An apparatus according to claim 12, in which an arrangement which is symmetrical with respect to a horizontal central plane of the slide or guide, which contains the axis of rotation of the particular tool-carrier, is provided for the rollers which mediate mounting.

14. An apparatus according to claim 13, in which at least four of the rollers are provided, which are arranged in pairs on the narrow profile legs of the C-shaped shaft profile.

15. An apparatus according to claim 13, in which on their periphery, the rollers have splined profiling which is in form-locking engagement with at least one marginal region of a disc-shaped bearing element belonging to the drum-shaped tool-carrier.

16. An apparatus according to claim 15, in which at least one of the rollers is in an engagement in a radial direction, with the drum-shaped tool-carrier, and is provided with its own rotatory driving apparatus.

17. An apparatus according to claim 7, further comprising a drive capable of travelling between various discharging positions.

18. An apparatus for personalized provisioning of medicament-dispensers, the apparatus comprising:

a magazine store for holding a plurality of vertically aligned standard blister packs, each of the blister packs having a plurality of trough-shaped cups covered with a blister film and enclosing an administering unit of medicaments, the plurality of blister packs structured to be guided to slide vertically within magazine shafts which are respectfully assigned to various medicaments;

a de-blistering device scratching or cutting to facilitate an opening of the cover of one of the cups of the blister pack;

a transporting apparatus for positioning the medicament-dispensers at a delivery apparatus;

an electronic control unit which generates, from a system for processing machine-readable, person-related data which can be read and processed in a defined correlation with the transport of the dispensers, control signals to drive electronically controllable drives for the de-blistering device and the delivery apparatus;

a plurality of installation modules each having a blister-pack shaft, a punching apparatus separate from the de-blistering device, and the delivery apparatus arranged so as to be capable of being mounted, along the transporting apparatus, at distances from one another which correspond to a distance between receiving compartments in the medicament-dispensers or to an integral multiple of the distance;

for each magazine shaft, a slide which receives a lowest blister pack in a respective stack, the slides structured to shift into a receiving position after one of the blister packs which has been emptied is removed, and structured to push the blister pack out of the position again and into a de-blistering and provisioning station;

in which:

the slides include a guide part, for horizontally displaceable guidance and a window part to receive the blister packs in a form-locking manner, the window part of the slide being rotatable, relative to the guide part, by 180° about a common central longitudinal axis of the slide; and in which:

the slides can be shifted out of the particular magazine shaft, transversely to the transporting apparatus of the medicament-dispensers, to an extent such that it is possible to carry out, in a de-blistering region, the scratching or cutting of the covering films of the blister packs, a removal of the medicament from the cup which has been opened in a separate action from the scratching or cutting, and a delivery of the medicament to the particular medicament-dispenser.

* * * * *

UNITED STATES PATENT AND TRADEMARK OFFICE

CERTIFICATE OF CORRECTION

PATENT NO. : 8,365,507 B2
APPLICATION NO. : 12/304245
DATED : February 5, 2013
INVENTOR(S) : Hans Klingel It is certified that error appears in the above-identified patent and that said Letters Patent is hereby corrected as shown below:

In the Claims

At Column 17, Line 4, the word "the" should be replaced with --a--

Signed and Sealed this
Fifth Day of August, 2014

Michelle K. Lee

Michelle K. Lee
*Deputy Director of the United States Patent and Trademark Office*